US005327150A

United States Patent [19]

Cherrette

[11] Patent Number: 5,327,150

[45] Date of Patent: Jul. 5, 1994

[54] PHASED ARRAY ANTENNA FOR EFFICIENT RADIATION OF MICROWAVE AND THERMAL ENERGY

[75] Inventor: Alan R. Cherrette, Hawthorne, Calif.

[73] Assignee: Hughes Aircraft Company, Los Angeles, Calif.

[21] Appl. No.: 25,477

[22] Filed: Mar. 3, 1993

[51] Int. Cl.[5] ..... H01Q 13/10

[52] U.S. Cl. ..... 343/771; 343/770

[58] Field of Search ..... 343/771, 770, 767, 768, 343/700 MS, 915, 916, DIG. 2, 872; H01Q 13/10

[56] References Cited

U.S. PATENT DOCUMENTS

| | | | |
|---|---|---|---|
| 4,581,614 | 4/1986 | Lacourse | 343/771 |
| 5,128,689 | 7/1992 | Wong et al. | 333/125 |
| 5,223,850 | 6/1993 | Branigan et al. | 343/771 |

*Primary Examiner*—Donald Hajec
*Assistant Examiner*—Hoanganh Le
*Attorney, Agent, or Firm*—William J. Streeter; Wanda K. Denson-Low

[57] ABSTRACT

An active phased array is provided that includes a plurality of subarrays (20) having an upper RF radiating panel assembly (22) including a plurality of radiating waveguides (26) and a feed waveguide (24) all formed of aluminum. RF radiating slots (28) are cut into one wall of each of the radiating waveguides and a silver-quartz mirror (42), with corresponding slots (44), is bonded to the outside surface. The array further includes a non-RF radiating lower aluminum support panel assembly (34) with a silver-quartz mirror (46) bonded to the outside face. The mirrors efficiently radiate thermal energy in the presence of sunlight. An active electronics module (30) is mounted in an aluminum housing, and includes an RF probe (56). The module 30 is supplied with RF signals, control signals and DC bias voltage over transmission lines contained in a multilayered circuit board (32). RF energy emitted by the probe is coupled from the feed waveguide to the radiating waveguides. Heat generated by the electronics module is conducted through the aluminum housing of the active electronics modules and transferred to the outer surfaces of the upper and lower panel assemblies where it is radiated into cold space.

7 Claims, 6 Drawing Sheets

PHASED ARRAY ANTENNA FOR EFFICIENT RADIATION OF MICROWAVE AND THERMAL ENERGY

FIELD OF THE INVENTION

This invention relates to phased array antennas and more particularly to a lightweight active phased array antenna that permits efficient radiation of microwave energy as well as efficient radiation of thermal energy in the presence of sunlight.

BACKGROUND OF THE INVENTION

For commercial communications satellite applications, active phased array payloads require more bias power and dissipate more thermal energy than conventional payloads. Therefore, they require a very lightweight structure to offset the weight increase in the power supply needed to produce the same effective isotropic radiated power (EIRP). The active phased array must also radiate RF and thermal energy efficiently to maintain reasonable array areas and surface temperatures.

SUMMARY OF THE INVENTION

According to the present invention, an active phased array is provided that produces EIRP performance equivalent to that of conventional commercial payloads but at reduced weight and cost as compared to the prior art. The array includes a plurality of subarrays, each of which comprises an upper RF radiating structure made of aluminum. The upper structure includes a plurality of radiating waveguides and a feed waveguide. RF radiating slots are cut into one wall of each of the radiating waveguides. A silver-quartz mirror is bonded to the outside surface of the upper radiating surface. Slots are etched in the silver coating of the quartz mirror to correspond with each radiating slot, so as not to obstruct the RF energy radiated. The array further includes a non-RF radiating lower aluminum support structure with a silver-quartz mirror bonded to the outside face. The silver-quartz mirrors on the exterior surfaces of the array provide a structure for efficiently radiating thermal energy in the presence of sunlight.

An active electronics module, mounted in a housing of aluminum, includes an RF probe, and associated electronics. The RF probe extends through the module housing into the feed waveguide and emits RF energy that is coupled from the feed waveguide to the radiating waveguides. The electronics module is thermally connected to the aluminum support structure on the bottom side of the array and to the RF radiating structure on the top side of the array. Heat generated by the electronics module is conducted through the aluminum housing of the active electronics modules and transferred to the top and bottom surfaces where it is radiated into cold space. Since there are many identical subarray elements and electronic modules in the active array, the heat sources are uniformly distributed over the aperture area of the array. Consequently, the need for heat pipes and thermal doublers is eliminated. This passive thermal design, along with a single structure that combines RF and thermal radiating functions along with the mechanical integrity greatly reduces the weight of the communications payload.

BRIEF DESCRIPTION OF THE DRAWINGS

A more thorough understanding of the present invention may be had from the following detailed description, which should be read with the drawings, in which.

DETAILED DESCRIPTION OF THE PREFERRED EMBODIMENT

Figure 1:
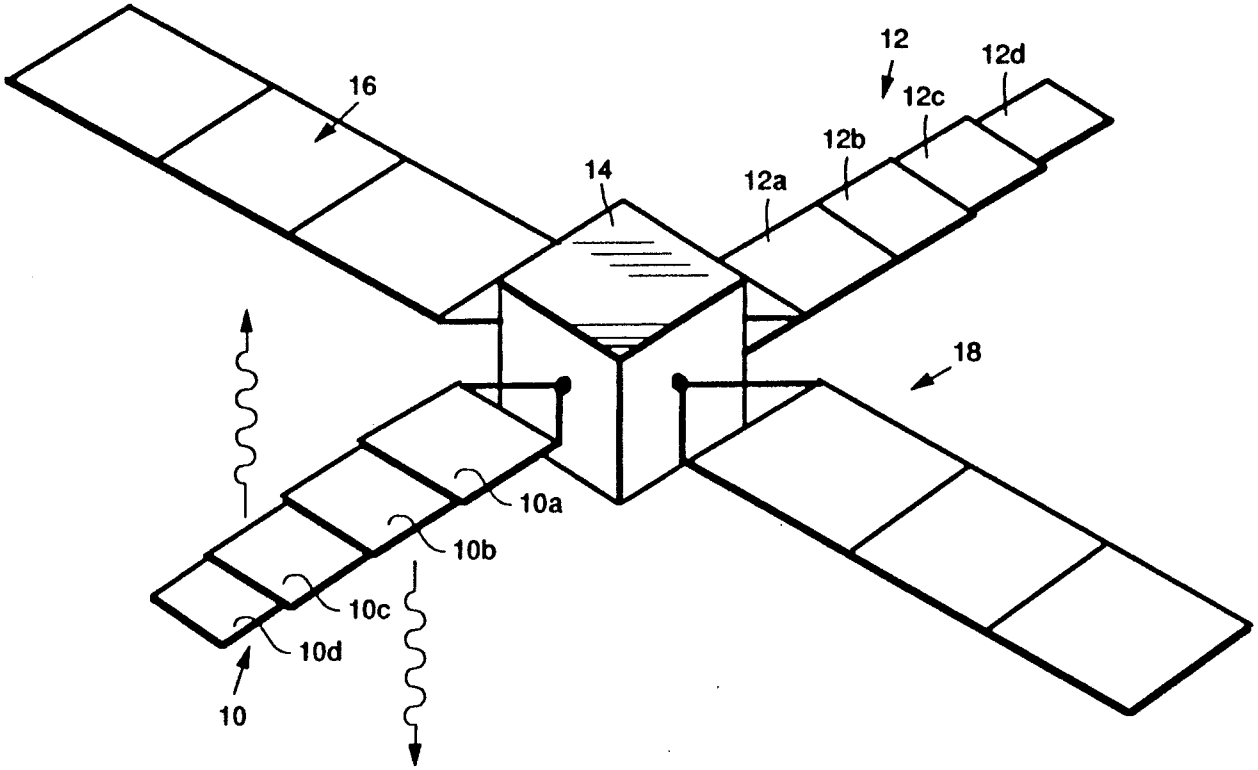
FIG. 1 depicts a set of active array panels deployed from a body stabilized communications spacecraft similar to deployment of solar panels.
Figure 2:
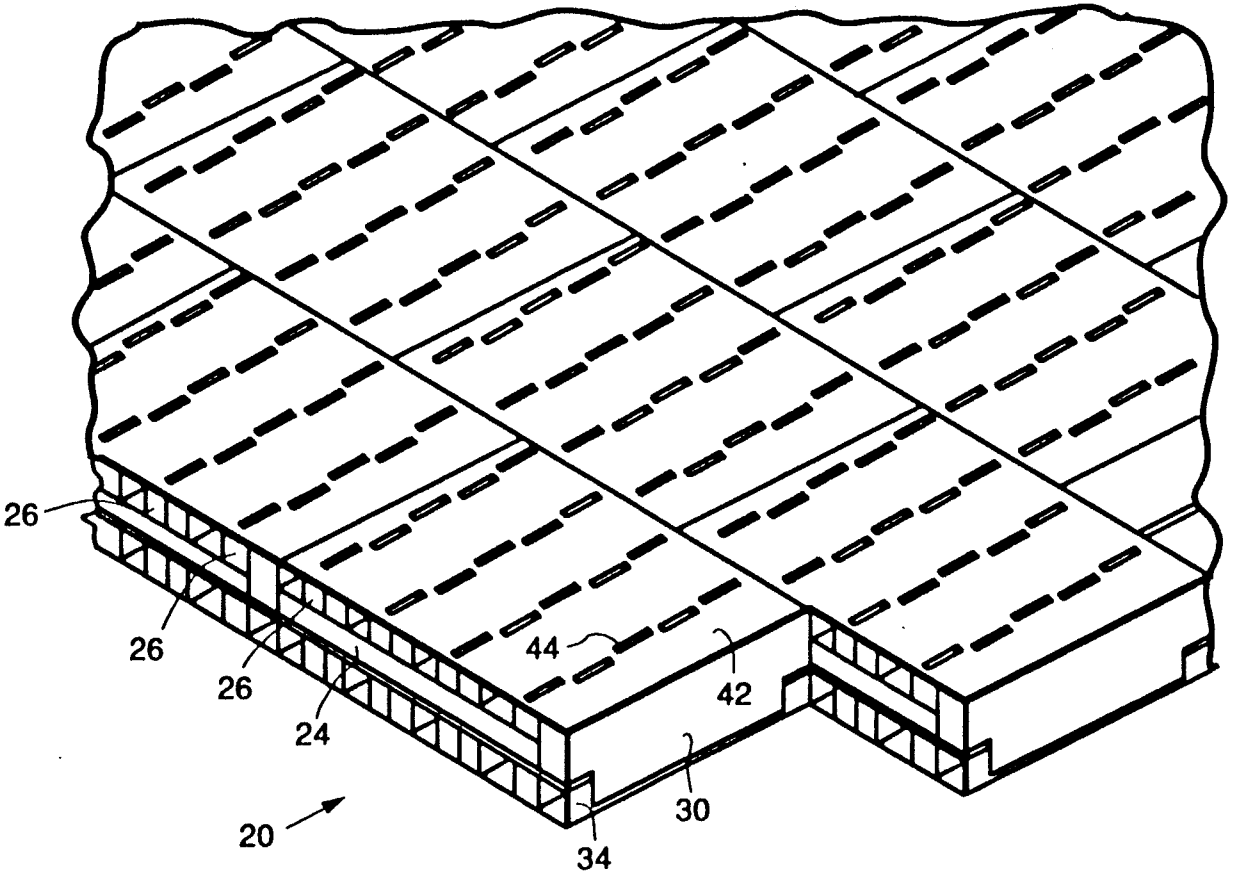
FIG. 2 depicts a plurality of subarray elements arranged in a triangular lattice.

Referring now to the drawings and initially to FIG. 1, a set of active array panels 10, 12 are deployed from a body stabilized spacecraft 14 similarly to the deployment of a pair of solar panel 16 and 18. Each of the array panels 10, 12, include a plurality of separate active array antenna, 10*a*–10*d*, 12*a*–12*d* respectively. Each array antenna may comprise many subarray elements, the number depending on the required total radiated RF power. These subarrays elements generally designated 20 are arranged in a triangular lattice as shown in FIG. 2. For a given required EIRP over a particular coverage area, the dissipated power density decreases as the number of subarray elements increases. When the number of subarray elements is large enough, the array area is sufficient to radiate the dissipated thermal power. For typical commercial communications satellite applications, 400 subarray elements are usually sufficient.

Figure 3:
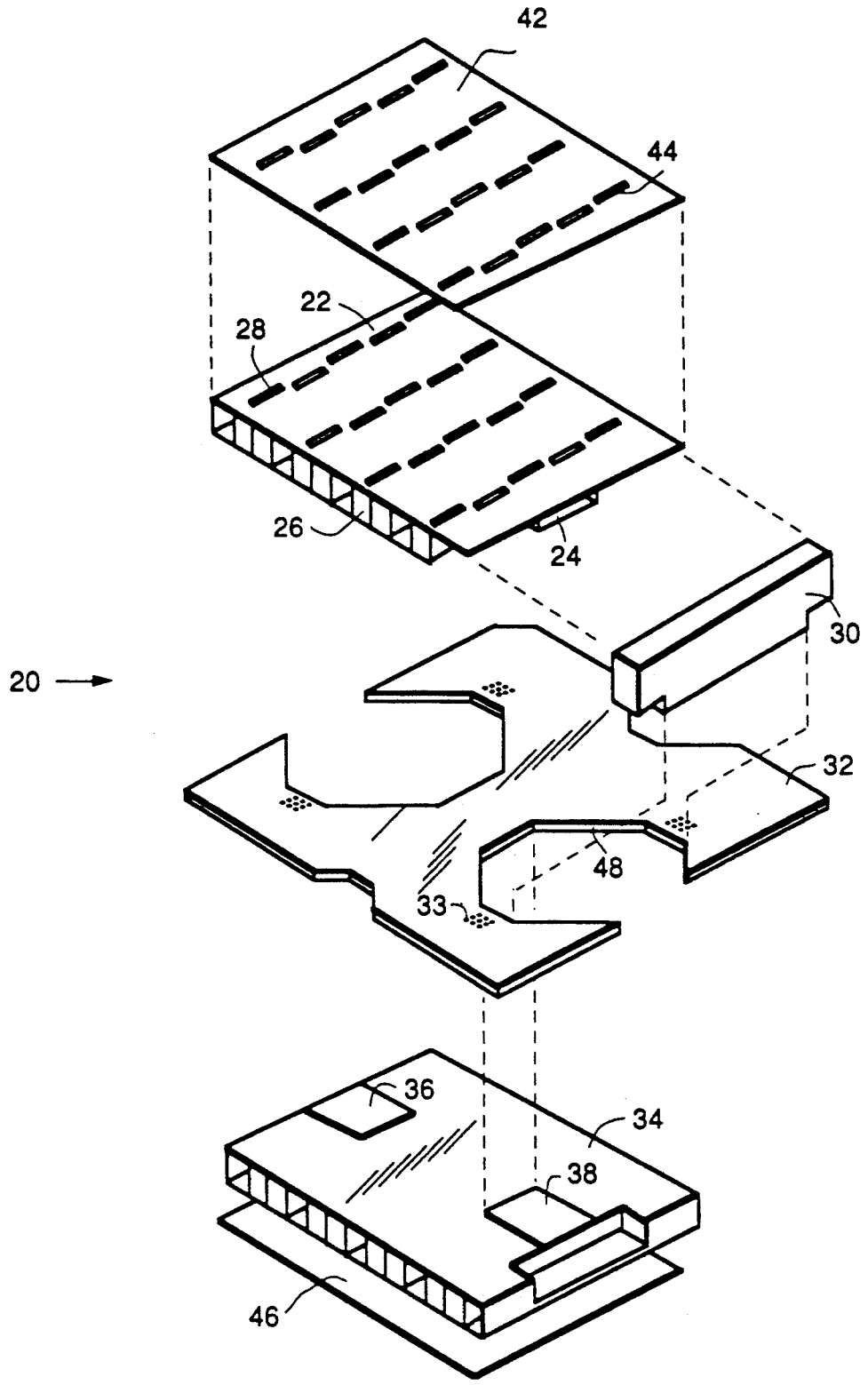
FIG. 3 is an exploded view of a subarray element.

Referring now to FIG. 3, a subarray element 20 includes an aluminum upper panel assembly 22 having a feed waveguide 24 that is coupled with a plurality of radiating waveguides 26. Each radiating waveguide is provided with a plurality of radiating slots 28 for transmitting RF energy. The RF energy is generated from electronic devices housed within an electronic module 30 made of aluminum, and communicated by way of the feed waveguide 24 and radiating waveguides 26. The electronics devices in the module 30 may include a solid state power amplifier, variable phase shifter, variable attenuator and control circuitry. The module 30 is supplied with RF signals, control signals and DC bias voltage over transmission lines, contained in a multilayered circuit board 32, and connected with electronics module 30 by pin connectors 33. All the heat in the active array is produced by the electronic module 30 associated with each subarray 20 in the antenna.

A non RF radiating lower panel assembly 34, formed of aluminum, is of the same general structural configuration as the plurality of radiating waveguides 26 in the upper panel assembly 22. Alternatively, the lower panel assembly 34 may be of a honeycomb or any other configuration that will provide support and add rigidity to the overall array structure. The panel assembly 34 includes raised portions or pads 36 and 38 that support the feed waveguide 24. A silver-quartz mirror 42 is bonded to the surface of the upper panel 22. So as not to obstruct the RF radiation, slots 44 coinciding with the slots 28, are etched in the silver coating of the quartz mirror 42. A silver-quartz mirror 46 is also bonded to the back side of the non-RF radiating lower panel 34. A portion of circuit board 32 is removed, as indicated at 48, for receiving the pad 38 and the electronic module 30.

The upper panel 22 of each of the subarray elements 20 is preferably machined from a single piece of aluminum during manufacture of the array. Likewise, the lower panels 34 of the subarray elements 20 may be machined from a single piece of aluminum. Also, the multilayered board is preferably constructed as a single board instead of individual boards and panels for each subarray. This is depicted in the exploded view of FIG. 3 where the board is shown as continuing beyond the single subarray, with a portion removed in order to accommodate an electronic module associated with an adjacent subarray.

Figure 4:
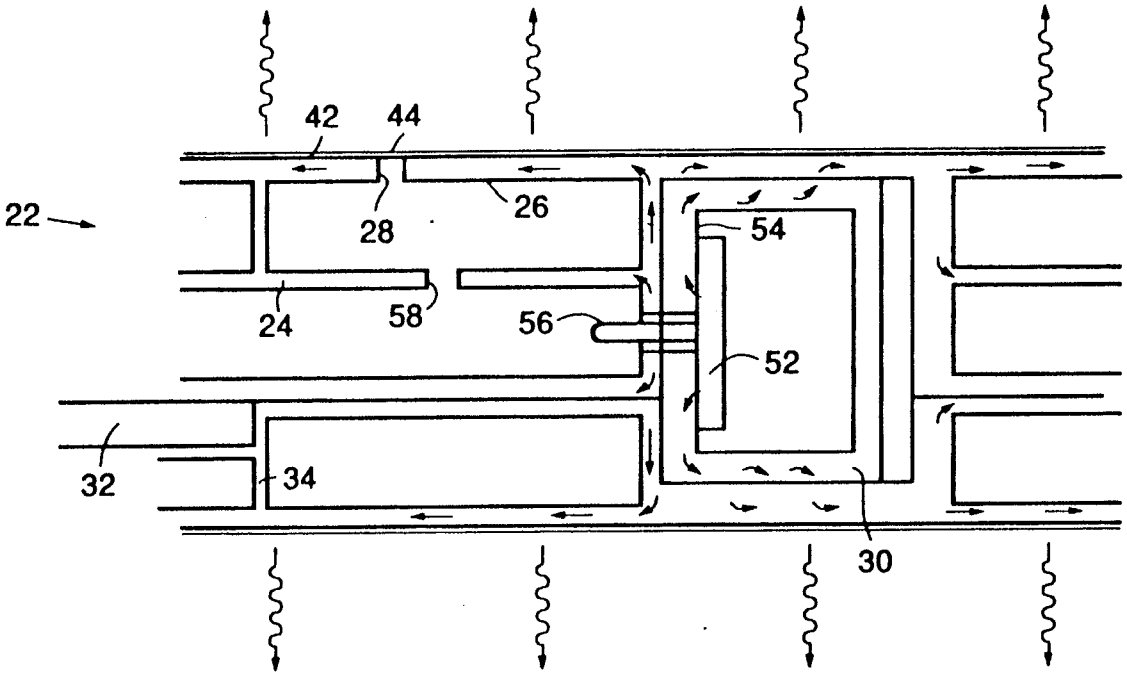
FIG. 4 is a cross-sectional view of a subarray element of FIG. 3 and depicts the heat rejection path for the element.

Referring now to FIG. 4, the active electronic devices are mounted on a circuit board 52 that is secured to an interior wall 54 of the module 30. A wire loop probe 56 is supported by the board 52, is electrically connected with the electronic devices on the board, and extends within the feed waveguide 24. A coupling slot 58 is provided to couple RF energy from the feed waveguide 24 to the radiating waveguide 26. The RF energy is radiated from the antenna through the radiating slots 28. The arrows shown within the aluminum structure, in FIG. 4, show the heat conduction paths from the active electronics heat source. Heat generated by the electronic devices on the board 52 is conducted through the aluminum housing of the module 30 and transferred to both the upper and lower panels 22 and 34. Heat is radiated from the panels into cold space. There are many identical subarray elements forming the array, each with an associated electronic heat source. Consequently, the heat sources are uniformly distributed throughout the active array. The heat pipes and thermal doublers used in the prior art, are therefore not needed, greatly reducing the weight of the antenna.

Figure 5:
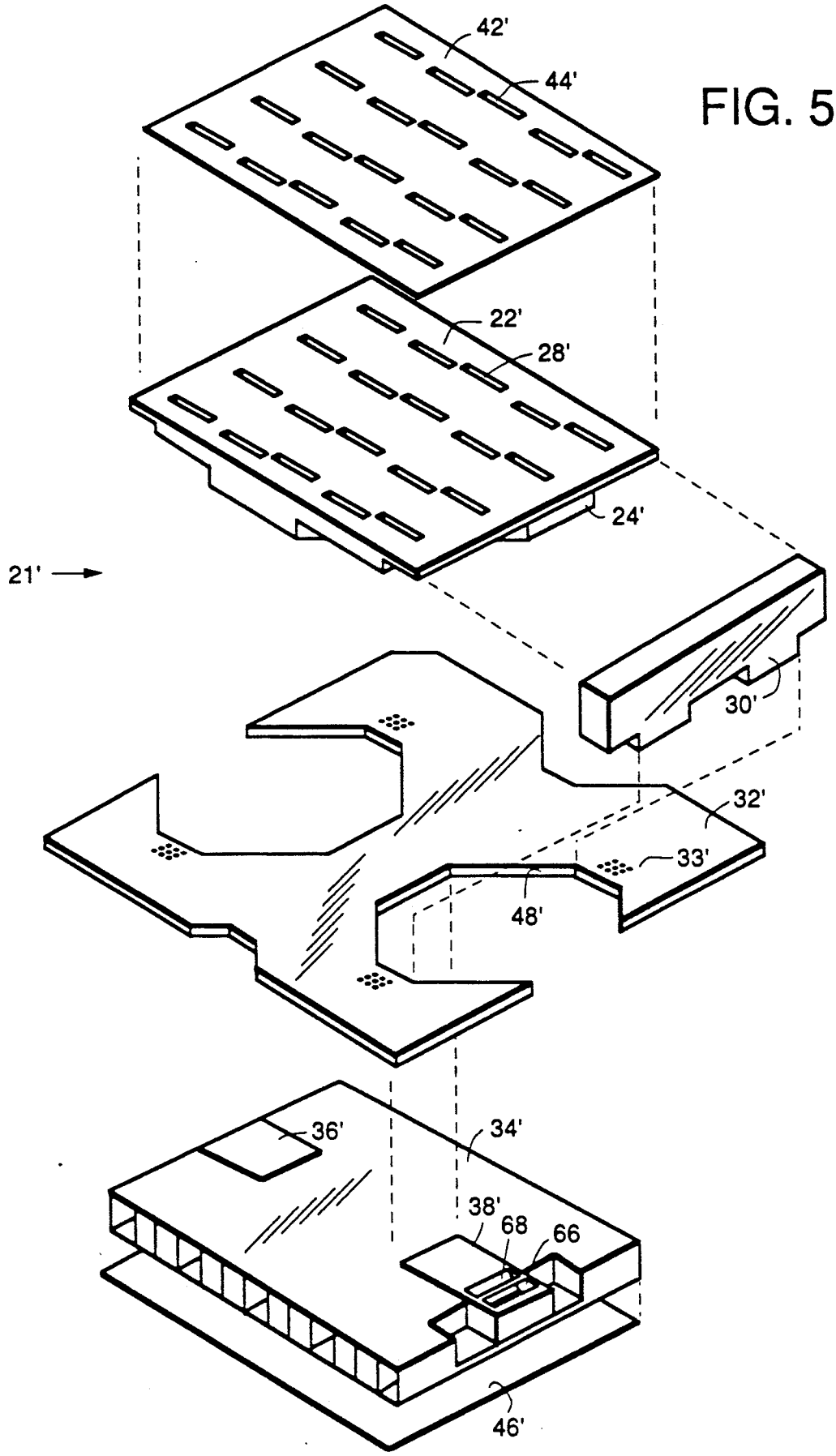
FIG. 5 is an exploded view of a subarray element of a second embodiment of the invention.
Figure 6:
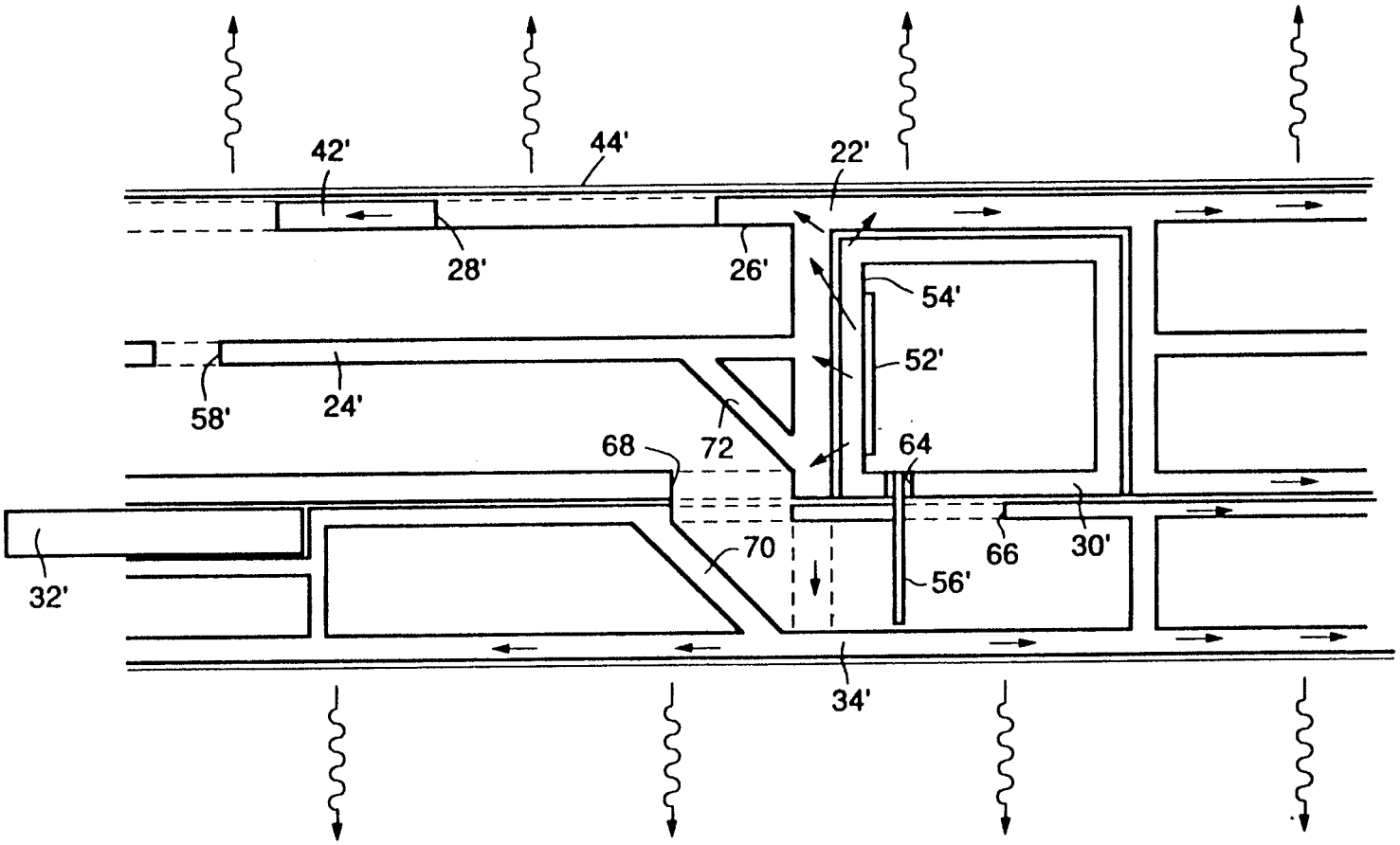
FIG. 6 is a cross-cross-sectional view of the subarray of FIG. 5 and depicts the heat rejection path for the element.

Referring now to FIGS. 5 and 6, a second embodiment of the invention is shown with corresponding elements designated by prime numbers. In this embodiment the slots 28' and 44' are parallel to the direction of heat flow from the active electronics on the circuit board 52'. This orientation of the slots present less resistance to conduction of heat from the electronics than does the perpendicular orientation of the slots 28 and 44 of FIG. 3. A further modification in this embodiment is the manner in which probe 56' is attached to the circuit board 52' as shown in FIG. 6. The probe 56' extends downwardly from the board 52', through an opening 64 in the module 30' instead of perpendicular to the board as in FIG. 4. This permits a press fit connection for all pin connectors 33' supplying RF signals and DC control signals, along the bottom edge of the module 30'. In FIG. 6, the probe extends through a rectangular opening 66 in the pad 38' and communicates with the feed waveguide 24' through a rectangular opening 68. The RF energy emitted from the probe 56' encounters two E-plane bends 70 and 72 in the lower panel 34' and feed waveguide 24' respectively, and exits the feed waveguide at the four coupling slots 58', one of which is shown in FIG. 6. Each slot 58' communicates with a radiating waveguide 26' where the RF energy is radiated from the array through the slots 28'. Preferably, the slots 58' are disposed at angle relative to the slots 28' for example, alternating between +45 degrees and −45 degrees relative to the orientation of the slots in the four radiating waveguides 26'.

While the forms of the invention herein disclosed constitute presently preferred embodiments, many others are possible. It is not intended herein to mention all of the possible equivalent forms or ramifications of the invention. It is understood that the terms used herein are merely descriptive rather than limiting, and that various changes may be made without departing from the spirit or scope of the invention.

What is claimed is:

1. An active phased array antenna for radiating both microwave and thermal energy comprising a plurality of subarray elements, each subarray element comprising;

heat generating means including electronic circuit means comprising a plurality of electronic components including an RF amplifying means for amplifying radio frequency energy, housing means formed of heat conducting material, means mounting said circuit means in heat conducting relationship with said housing means, RF probe means connected with said electronic circuit means, said housing means including an opening for receiving said RF probe means, an upper panel assembly of heat conducting material including a feed waveguide and a plurality of radiating waveguides, said feed waveguide adapted to receive energy generated from said RF amplifying means and including a plurality of coupling slots for coupling said RF energy to respective ones of said plurality of radiating waveguides, each of said radiating waveguide including a plurality of radiating slots therein for radiating RF energy, a first mirror bonded to an outside surface of said upper panel assembly and having slots etched therein which are aligned with said radiating slots;

a lower panel assembly of heat conducting material, a second mirror bonded to an outside surface of said lower panel assembly, means joining at least some portion of said upper and lower assemblies in heat conducting contact with each other and with said housing means to form a composite assembly, a circuit board positioned between said upper and lower panel assemblies for distributing power and control signals to said electronic circuit means.

2. The invention defined in claim 1 in which said mirrors are silver-quartz mirrors.

3. The invention defined in claim 2 in which said heat conducting material is aluminum.

4. The invention defined in claim 3 in which said radiating slots are substantially aligned with the direction of heat conduction in said radiating waveguides.

5. The invention defined in claim 4 in which said lower panel assembly includes a pair of raised support pads in thermal contact with said upper panel assembly.

6. The invention defined in claim 5 in which one of said pads is a hollow waveguide structure adapted to couple RF energy to said feed waveguide and is provided with an opening for receiving said RF probe means.

7. The invention defined in claim 3 in which the antenna is deployed from a spacecraft and allows thermal energy to be radiated from the outwardly facing surfaces of each panel into cold space.

* * * * *